US009862079B2

(12) United States Patent
Hsieh

(10) Patent No.: US 9,862,079 B2
(45) Date of Patent: Jan. 9, 2018

(54) ELECTRONIC TORQUE WRENCH WITH EARLY-WARNING FUNCTION

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 285 days.

(21) Appl. No.: 14/846,228

(22) Filed: Sep. 4, 2015

(65) Prior Publication Data

US 2016/0221166 A1 Aug. 4, 2016

(30) Foreign Application Priority Data

Jan. 30, 2015 (TW) ..... 104103241 A

(51) Int. Cl.
*B25B 23/142* (2006.01)

(52) U.S. Cl.
CPC ..... *B25B 23/1425* (2013.01)

(58) Field of Classification Search
CPC ..... B25B 23/1425
USPC ..... 81/467, 479
See application file for complete search history.

(56) References Cited

U.S. PATENT DOCUMENTS

| | | | | |
|---|---|---|---|---|
| 4,562,746 | A * | 1/1986 | Petit | B25B 23/14 73/862.23 |
| 8,166,853 | B2 * | 5/2012 | Rainone | B25B 23/1425 73/862.22 |
| 8,171,828 | B2 * | 5/2012 | Duvan | B25B 13/462 73/862.21 |
| 9,000,936 | B2 * | 4/2015 | Hsieh | B25B 23/1425 340/665 |
| 9,283,663 | B2 * | 3/2016 | Hsieh | B25B 23/1425 |
| 2014/0069211 | A1 * | 3/2014 | Backhaus | B25B 23/1425 73/862.23 |

* cited by examiner

*Primary Examiner* — Hadi Shakeri
(74) *Attorney, Agent, or Firm* — Guice Patents PLLC

(57) ABSTRACT

An electronic torque wrench with early-warning function includes a main body, a setting unit, a detecting unit, an operation unit, a warning unit and an early-warning program. A working head is disposed at one end of the main body for wrenching a work piece. The early-warning program is set with multiple early-warning times with different warning ranges. The value of the early-warning time is in direct proportion to the set torque value of the wrench. When the operation torque of the wrench reaches the early-warning time, the operation unit urges the warning unit to give a warning.

17 Claims, 7 Drawing Sheets

80

| ratio of set torque value | early-warning time |
|---|---|
| 21%~30% | 50% |
| 31%~40% | 60% |
| 41%~60% | 70% |
| 61%~80% | 80% |
| 81%~90% | 90% |

Fig. 4

| range of operation torque of the wrench | set torque value | ratio of set torque value | early-warning time | difference value Δt | |
|---|---|---|---|---|---|
| 10 (N-m) ~ 100 (N-m) | 10 (N-m) ~ 20 (N-m) | 1%~20% | 40% | 60% | R1 |
| | 21 (N-m) ~ 30 (N-m) | 21%~30% | 50% | 50% | R2 |
| | 31 (N-m) ~ 40 (N-m) | 31%~40% | 60% | 40% | R3 |
| | 41 (N-m) ~ 60 (N-m) | 41%~60% | 70% | 30% | R4 |
| | 61 (N-m) ~ 80 (N-m) | 61%~80% | 80% | 20% | R5 |
| | 81 (N-m) ~ 90 (N-m) | 81%~90% | 90% | 10% | R6 |
| | 91 (N-m) ~100 (N-m) | 91%~100% | 95% | 5% | R7 |

Fig. 5

| range of operation torque of the wrench | set torque value | early-warning time | early-warning torque value |
|---|---|---|---|
| 10 (N-m) ~100 (N-m) | 26 (N-m) | 50% | 13 (N-m) |
| | 70 (N-m) | 80% | 56 (N-m) |

Fig. 6

| range of operation torque of the wrench | set torque value | ratio of set torque value | early-warning time | difference value Δt | |
|---|---|---|---|---|---|
| 10 (N-m) ~ 200 (N-m) | 10 (N-m) ~ 40 (N-m) | 1%~20% | 40% | 60% | |
| | 41 (N-m) ~ 60 (N-m) | 21%~30% | 50% | 50% | R2 |
| | 61 (N-m) ~ 80 (N-m) | 31%~40% | 60% | 40% | |
| | 81 (N-m) ~ 90 (N-m) | 41%~60% | 70% | 30% | |
| | 121 (N-m) ~ 160 (N-m) | 61%~80% | 80% | 20% | |
| | 161 (N-m) ~ 180 (N-m) | 81%~90% | 90% | 10% | |
| | 181 (N-m) ~ 200 (N-m) | 91%~100% | 95% | 5% | R7 |

Fig. 7

| range of operation torque of the wrench | set torque value | early-warning time | early-warning torque value |
|---|---|---|---|
| 10 (N-m) ~200 (N-m) | 48 (N-m) | 50% | 24 (N-m) |
| | 190 (N-m) | 95% | 180.5 (N-m) |

| range of operation torque of the wrench | set torque value | ratio of set torque value | early-warning time | difference value Δt | |
|---|---|---|---|---|---|
| 10 (N-m) ~ 100 (N-m) | 10 (N-m) ~ 20 (N-m) | 1%~20% | 40% | 60% | |
| | 21 (N-m) ~ 30 (N-m) | 21%~30% | 50% | 50% | R2 |
| | 31 (N-m) ~ 40 (N-m) | 31%~40% | 60% | 40% | |
| | 41 (N-m) ~ 50 (N-m) | 41%~50% | 65% | 35% | |
| | 51 (N-m) ~ 60 (N-m) | 51%~60% | 70% | 30% | |
| | 61 (N-m) ~ 70 (N-m) | 61%~70% | 75% | 25% | |
| | 71 (N-m) ~ 80 (N-m) | 71%~80% | 80% | 20% | R7 |
| | 81 (N-m) ~ 90 (N-m) | 81%~90% | 90% | 10% | |
| | 91 (N-m) ~100 (N-m) | 91%~100% | 95% | 5% | |

Fig. 10

| range of operation torque of the wrench | set torque value | early-warning time | early-warning torque value |
|---|---|---|---|
| 10 (N-m) ~100 (N-m) | 26 (N-m) | 50% | 13 (N-m) |
| | 76 (N-m) | 80% | 60.8 (N-m) |
| | 100 (N-m) | 95% | 95 (N-m) |

Fig. 11

ELECTRONIC TORQUE WRENCH WITH EARLY-WARNING FUNCTION

BACKGROUND OF THE INVENTION

1. Field of the Invention

The present invention relates generally to an electronic torque hand tool, and more particularly to an electronic torque wrench with early-warning function.

2. Description of the Related Art

A conventional electronic torque wrench generally has torque warning function. A user can set a torque warning value according to the necessary tightening torque for different threaded members. When the operation torque of the wrench reaches the torque warning value, the wrench will give a warning to remind the user that the operation torque has reached the set torque value and he/she should stop wrenching the threaded member so as to avoid over-tightening thereof.

However, inertia will take place when operating and applying a force to a hand tool. Therefore, when the user finds the warning or reminder, the user often fails to immediately stop wrenching the threaded member and will further wrench the threaded member with the wrench for a short period of time. Under such circumstance, the inertial application force will lead to extra torque applied to the threaded member and the operation torque of the wrench may exceed the necessary tightening torque for the threaded member. As a result, the threaded member will be over-tightened by error.

In order to solve the problem that the inertial application force will cause the real tightening torque is greater than the necessary/set tightening torque for the threaded member, the applicant's U.S. Pat. No. 9,283,663 has disclosed an electronic torque wrench, according to the electronic torque wrench, a user can set a torque warning value lower than the necessary tightening force for the threaded member. Therefore, the real tightening torque will not exceed the necessary tightening force for the threaded member after the force is inertly applied to the threaded member. This solves the problem caused by the inertial application force.

The above patent can truly solve the problem caused by the inertial application force, however, such electronic torque wrench is still not optimal. This is because the affection of the inertial application force on different threaded members necessitating different tightening torques is varied. For a threaded member necessitating greater tightening torque, after the force is inertly applied to the threaded member, the tightening force is relatively unlikely to exceed the necessary tightening force. However, for a threaded member only necessitating small tightening torque, after the force is inertly applied to the threaded member, the tightening force is easy to exceed the necessary tightening force.

Therefore, with respect to a threaded member only necessitating small tightening torque, a user is still hard to stop wrenching the threaded member in a very short time to avoid over-tightening.

It is therefore tried by the applicant to provide an electronic torque wrench with early-warning function. Moreover, the extent to which the early-warning is made earlier is varied with different threaded members necessitating different tightening torques so as to solve the above problem.

SUMMARY OF THE INVENTION

It is therefore a primary object of the present invention to provide an electronic torque wrench with early-warning function. Before the operation torque of the wrench reaches the necessary tightening torque for a work piece, an early warning is previously given to make a user stop wrenching the work piece in time so as to avoid over-tightening.

It is a further object of the present invention to provide the above electronic torque wrench with early-warning function, in which the early-warning function is automatically adjustable to have different early-warning times according to different values of the necessary tightening torques.

It is still a further object of the present invention to provide the above electronic torque wrench with early-warning function, in which the early-warning time is made earlier to an extent in reverse proportion to the value of the tightening torque of the work piece.

To achieve the above and other objects, the electronic torque wrench with early-warning function of the present invention includes: a main body; a working head disposed at one end of the main body; a setting unit disposed on the main body for setting a set torque value; a detecting unit disposed in the main body for detecting operation torque of the wrench; an operation unit disposed in the main body and connected to the setting unit and the detecting unit; a warning unit disposed in the main body and connected to the operation unit; and an early-warning program disposed in the main body. The early-warning program is set with multiple early-warning times. The early-warning time is defined as a ratio value of the operation torque value of the wrench to the set torque value when the early-warning effect is activated. The value of the early-warning time is in direction proportion to the set torque value. When the operation torque of the wrench reaches the corresponding early-warning time, the operation unit urges the warning unit to give a warning.

Alternatively, the electronic torque wrench with early-warning function of the present invention includes: a main body; a working head disposed at one end of the main body; a display unit disposed on the main body; a setting unit disposed on the main body for setting a set torque value; a detecting unit disposed in the main body for detecting operation torque of the wrench; an operation unit disposed in the main body and connected to the setting unit and the detecting unit; a warning unit disposed in the main body and connected to the operation unit; and multiple ranges inbuilt in the torque wrench. Multiple early-warning times with different ratio ranges fall within the ranges respectively. The early-warning time is defined as a ratio value of the operation torque value of the wrench to the set torque value when the early-warning effect is activated. The value of the early-warning time is in direct proportion to the set torque value. When the operation torque of the wrench reaches the corresponding early-warning time, the operation unit urges the warning unit to give a warning.

Accordingly, the electronic torque wrench of the present invention provides multiple early-warning times with different warning ranges according to different values of the necessary tightening torques. Before the operation torque of the wrench reaches the necessary tightening torque for a work piece, an early warning is previously given to avoid over-tightening of the work piece. Moreover, the electronic torque wrench can selectively provide different early-warning times according to different set torque values.

In the above electronic torque wrench with early-warning function, the early-warning time is made earlier to an extent in reverse proportion to the value of the tightening torque of the work piece. That is, the smaller the necessary tightening torque for the work piece is, the earlier the early-warning time is made.

The present invention can be best understood through the following description and accompanying drawings, wherein:

BRIEF DESCRIPTION OF THE DRAWINGS

FIG. 4 is a comparison table of the preferred embodiment of the electronic torque wrench of the present invention, showing the relationship between the ratio of set torque value and the early-warning time;

FIG. 5 is a comparison table of the preferred embodiment of the electronic torque wrench of the present invention, showing the relationship between the set torque value and the early-warning time in a first application;

FIG. 6 is a table according to FIG. 5, showing the early-warning time and early-warning torque value of a specific set torque value;

FIG. 7 is a comparison table of the preferred embodiment of the electronic torque wrench of the present invention, showing the relationship between the set torque value and the early-warning time in a second application;

FIG. 10 is a comparison table of the preferred embodiment of the electronic torque wrench of the present invention, showing the relationship between the set torque value and the early-warning time in a third application; and FIG. 11 is a table according to FIG. 10, showing the early-warning time and early-warning torque value of a specific set torque value.

DETAILED DESCRIPTION OF THE PREFERRED EMBODIMENTS

Definitions of Terms

The operation torque range Tg of the wrench: This means the range from the operable minimum torque value to the operable maximum torque value of the wrench under the specification of the wrench in condition of security use. For example, in the case that the operable minimum torque value Tmin is 1 N-m and the operable maximum torque value Tmax is 200 N-m, the operation torque range of the wrench is 1~200 N-m.

Real operation torque Tr: The instantaneous torque value when using the wrench to wrench a work piece, such as a threaded member.

Set torque value Ts: The warning value set according to the necessary tightening torque for the work piece. The set torque value can be, but not limited to, the necessary tightening torque for the work piece. For example, the set value can be slightly lower than the necessary tightening torque.

Early-warning torque value Ta: This means the torque value activating the warning effect. The early-warning torque value is the product of the real operation torque and the early-warning time. The early-warning torque value is not larger than the set torque value.

Ratio of set torque value: This means the ratio of the set torque value to the operable maximum torque value of the wrench.

Ratio range of the set torque value: This means the ratio range classified from the ratio of the set torque value to the operable maximum torque value of the wrench.

Early-warning time toa: The early-warning time is varied with the change of the set torque value Ts. The present invention has an early-warning program. The early-warning time is a ratio value set by the early-warning program for providing early-warning effect. The early-warning time is defined as a ratio relationship of the operation torque value to the set torque value when activating the early-warning effect. The early-warning time is set by the manufacturer and generally unchangeable by a consumer. The early-warning time is open to and changeable by a user only for some specific or professional wrench model numbers.

Difference value Δt from early-warning time to completion of operation: In the case that the operation is completed when the real operation torque reaches the set torque value, the completion degree is 100%. The difference value Δt is a ratio and referred to as a value difference from the set torque value after completed. For example, in case the early-warning time is 40%, then the difference from the early-warning time to the completion of operation is 100%−40%=60%.

Figure 1:
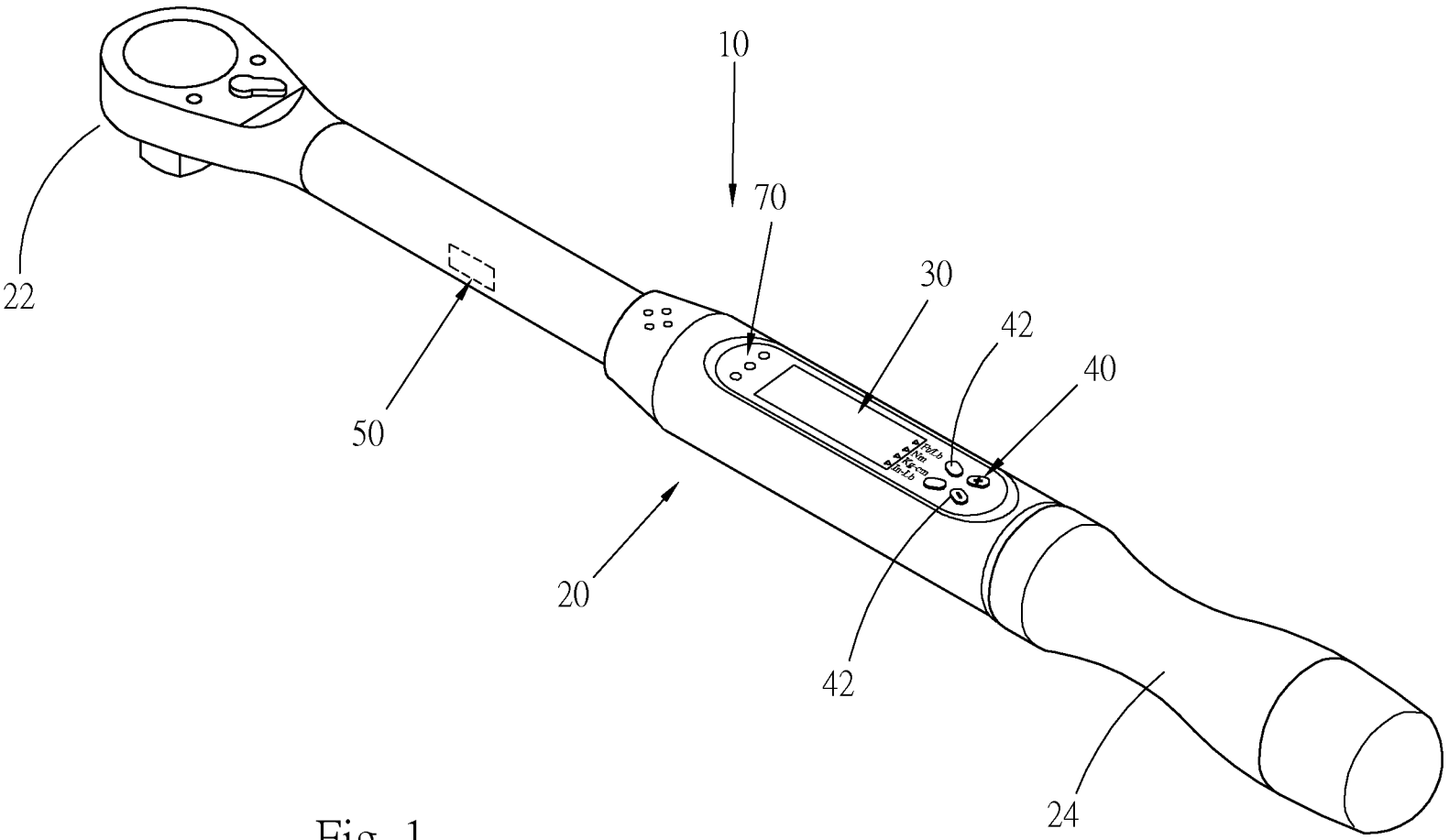
FIG. 1 is a perspective view of a preferred embodiment of the electronic torque wrench of the present invention.
Figure 2:
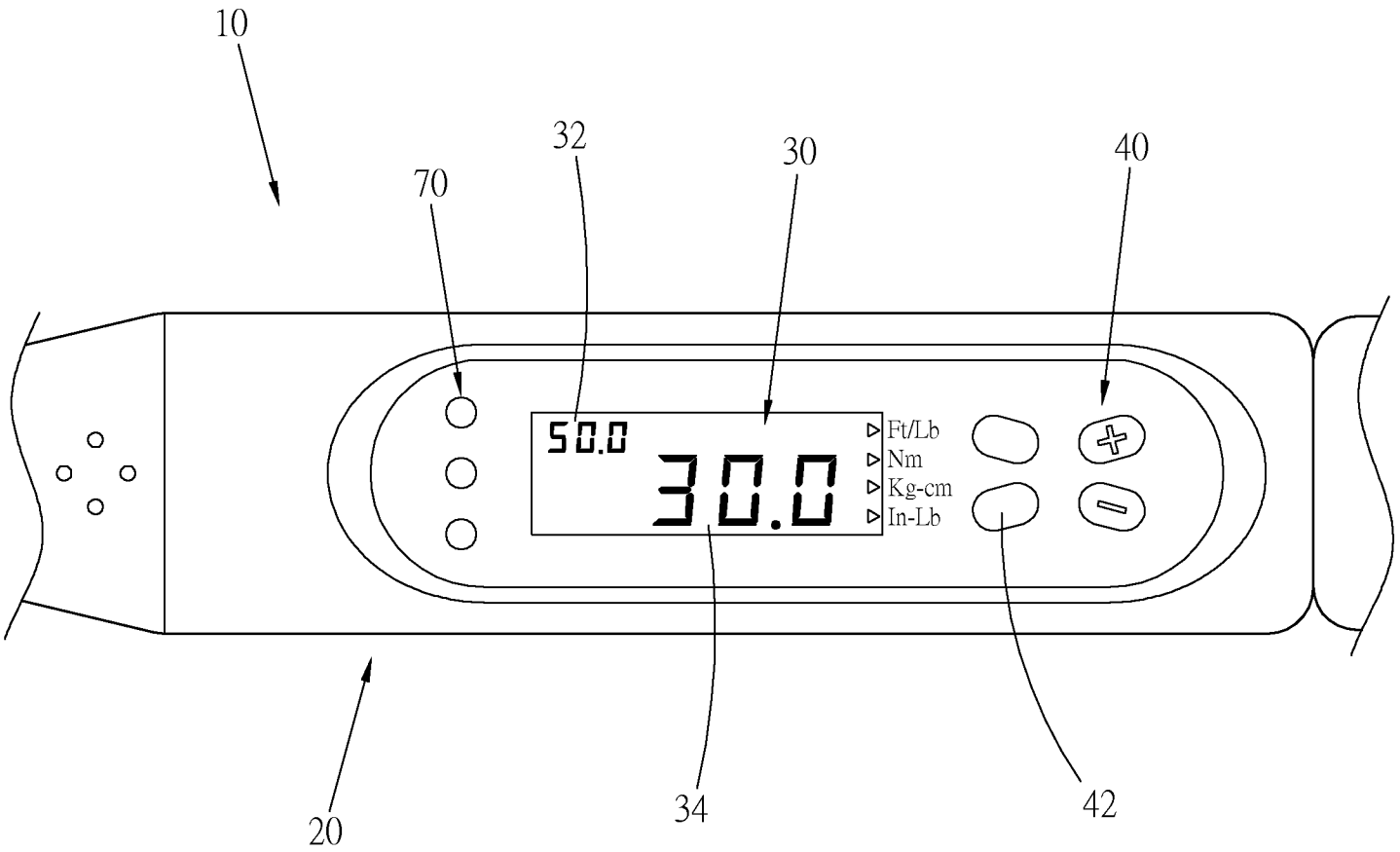
FIG. 2 is a partially front view according to FIG. 1.
Figure 3:
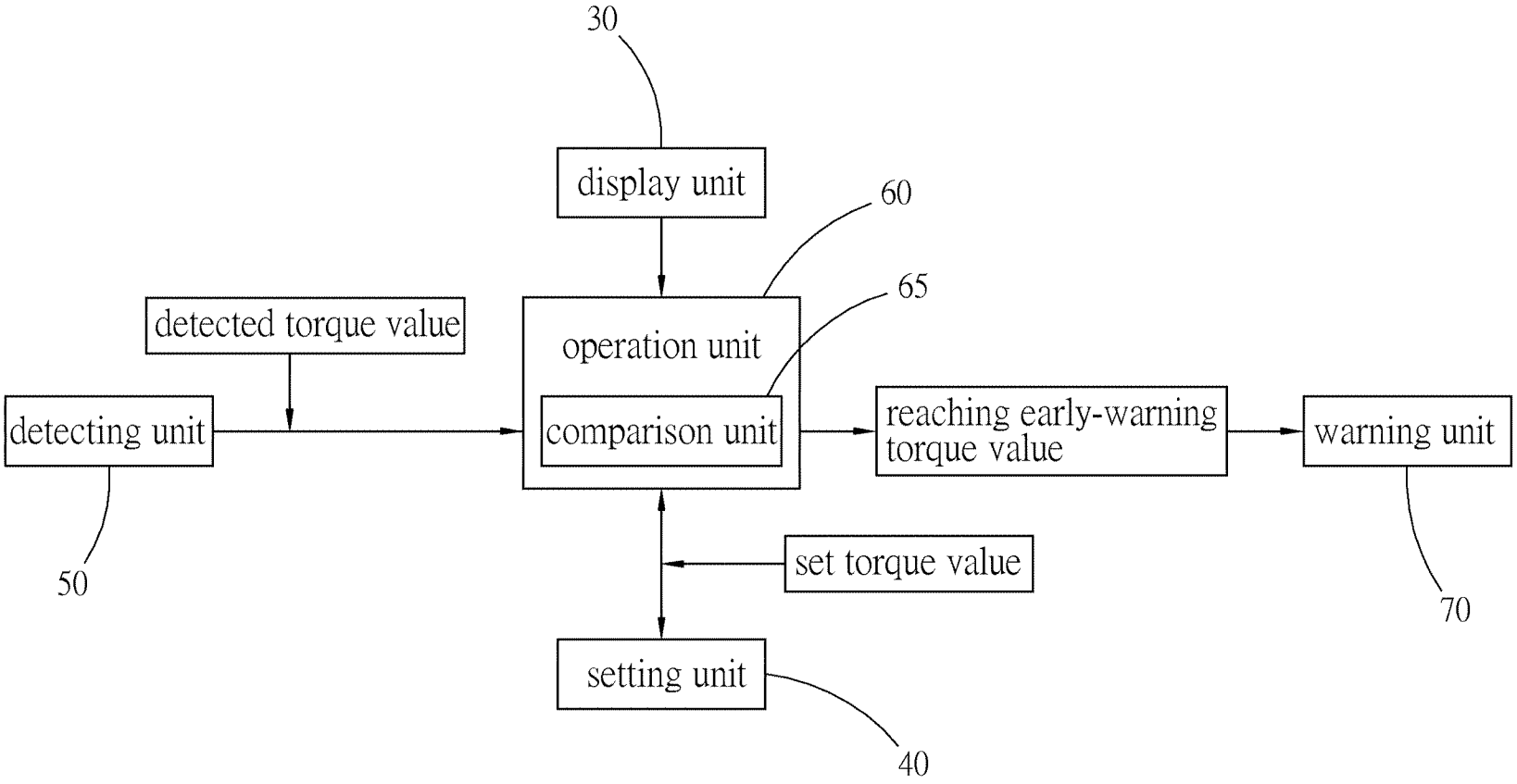
FIG. 3 is a block diagram of the preferred embodiment of the electronic torque wrench of the present invention.

Please refer to FIGS. 1 to 3. The electronic torque wrench 10 with early-warning function of the present invention includes a main body 20, a working head 22, a grip section 24, a display unit 30, a setting unit 40, a detecting unit 50, an operation unit 60, a comparison unit 65 and a warning unit 70.

The main body 20 is an elongated rod body. The working head 22 is disposed at one end of the main body 20 for inserting or fitting with a work piece to wrench the work piece. The work piece can be a bolt, a nut or a socket. The grip section 24 is disposed at the other end of the main body 20 for a user to hold to wrench the work piece. The display unit 30 is a liquid crystal screen disposed on outer circumference of the main body to display various data and information for a user to read.

The setting unit 40 has multiple pushbuttons 42 disposed on outer circumference of the main body for a user to selectively input various data and information including the torque value to be set. The display unit 30 can be a touch panel for inputting data.

The detecting unit 50 can be a detection/sensor component or circuit structure employed by the existent electronic torque wrench, such as a detector, a potentiometer, an ohmmeter or a Wheatstone bridge for detecting the operation torque of the wrench 10. The detecting unit 50 is not the subject matter of the present invention and thus will not be further described hereinafter. The detecting unit 50 is disposed in the main body 10 for detecting the application force (torque) of the wrench when wrenching the work piece and transmitting the detected torque value to the operation unit 60. After the operation unit 60 operates to transform the detected torque value, the real operation torque value Tr is shown on the display unit 30. The torque value can be selectively shown in metric system unit or British system unit, for example, N-m or ft-lbs.

The operation unit 60 is a microprocessor or a chip or integrated circuit with operation ability. The operation unit 60 is disposed in the main body 20 for receiving, operating and executing various commands. The comparison unit 65 serves to execute value comparison operation. The comparison unit 65 can be an independent component connected to the operation unit 60 or inbuilt in the operation unit, whereby the operation unit 60 itself can execute value comparison function. In the case that the comparison result matches the condition, the comparison unit 65 executes a command.

The warning unit 70 is a light (such as an LED light with three colors), a vibrator or a sound emitter (such as a buzzer) or an assembly thereof. The warning unit 70 utilizes light beam, vibration or sound to achieve warning effect.

The wrench 10 has an operation torque range Tg between an operable maximum torque value Tmax and an operable minimum torque value Tmin. In use, according to the necessary tightening force for the work piece to be tightened, an operator sets a set torque value. When the torque of the wrench 10 applied to the work piece for wrenching the work piece reaches the warning condition, the operation unit 60 urges the warning unit 70 to give a warning and achieve a warning effect.

The present invention is further inbuilt with an early-warning program 80 as shown in FIG. 4. The early-warning program 80 is connected to or inbuilt in the operation unit 60 to be executed by the operation unit. The early-warning program 80 is preset with multiple early-warning times toa to different extents according to different set torque values Ts. In this embodiment, in the case that the set torque values Ts is within a range from 21% to 30% the operable maximum torque value Tmax, then the early-warning time toa is 50%. The early-warning time is a ratio of the real operation torque Tr to the set torque value Ts. That is, when the real operation torque Tr reaches 50% the set torque value Ts, the warning system will be activated and the warning unit 70 will give a warning. Similarly, in the case that the set torque values Ts is within a range from 31% to 40% the operable maximum torque value Tmax, then the early-warning time toa is 60%. When the real operation torque Tr reaches 60% the set torque value Ts, the warning unit 70 will give a warning. In the case that the set torque values Ts is within a range from 81% to 90% the operable maximum torque value Tmax, then the early-warning time toa is 90%. When the real operation torque Tr reaches 90% the set torque value Ts, the warning unit 70 will give a warning. Accordingly, the present invention makes the early-warning time toa for giving the warning take place earlier. Especially, the early-warning time is varied with the different operation torques. With respect to a small operation torque, the early-warning time is earlier, while with respect to a great operation torque, the work piece is not so likely to be over-tightened due to inertial application force so that the early-warning time can be slightly delayed. Therefore, the work piece is prevented from being over-tightened due to inertial application force. Moreover, an optimal warning time can be provided in accordance with different operation torques.

Please now refer to FIG. 5, which is a comparison table of the electronic torque wrench of the present invention, showing the relationship between the set torque value and the early-warning time in a first application. In this application, the operation torque value of the wrench ranges from 10 N-m to 100 N-m. According to the ratio of the set torque value, the early-warning program 80 classifies set torque value into seven ratio ranges R1 to R7 respectively of 1%~20%, 21%~30%, 31%~40%, 41%~60%, 61%~80%, 81%~90% and 91%~100%. The early-warning program is inbuilt with seven early-warning times toa falling within the seven ranges R1 to R7 respectively. The early-warning times are respectively 40%, 50%, 60%, 70%, 80%, 90% and 95% in an ascending sequence. In this embodiment, the ratio of the set torque value is classified into seven ratio ranges falling within the seven ranges respectively. The seven difference values Δt are respectively 60%, 50%, 40%, 30%, 20%, 10% and 5% also falling within the seven ranges respectively.

Please refer to FIGS. 5 and 6. With the set torque value of 26 N-m and 70 N-m taken as an example, when the work piece is to be tightened by 26 N-m and the set torque value Ts is 26 N-m, the ratio of the set torque value falls within the range from 21% to 30%. At this time, the early-warning program 80 obtains that this set torque value is applicable to the early-warning time toa of 50% and calculates the early-warning torque value Ta to be 13 N-m, that is, 26 N-m×50%. The early-warning program 80 further transmits this information to the operation unit 60. The difference value Δt of the early-warning time is 50%.

After the setting is completed, a user uses the wrench 10 to wrench the work piece. The detecting unit 50 detects the operation torque Tr of the wrench 10 and transmits the detected torque value to the operation unit 60. The comparison unit 65 compares the detected torque value with the early-warning torque value Ta. When the detected torque value reaches the early-warning torque value Ta, that is, 13 N-m, the operation unit 60 activates the warning unit 70 to give a warning for reminding the user to stop wrenching. According to different operators, after inertly applying a force to the work piece, the torque value may reach between 18 N-m and 23 N-m. The user then further increases the tightening torque to 26 N-m to complete the wrenching operation of the work piece.

In the case that the torque for tightening the work piece is set 70 N-m, the ratio of the set torque value falls within the range from 61% to 80%. At this time, the set torque value is applicable to the early-warning time of 80% and the early-warning torque value is obtained to be 56 N-m and the difference value Δt of the early-warning time is 20%. When the application force of the user for wrenching the work piece reaches 56 N-m, the operation unit 60 activates the warning unit 70 to give a warning to make the user stop wrenching the work piece. With respect to different operators, the torque value after inertial application force to the work piece may reach between 61 N-m and 65 N-m, the user then can further increase the tightening torque to 70 N-m to complete the tightening operation for the work piece.

In the case that the torque for tightening the work piece is set 70 N-m, the ratio of the set torque value falls within the range from 61% to 80%. At this time, the set torque value is applicable to the early-warning time toa of 80% and the early-warning torque value Ta is 56 N-m and the difference value Δt of the early-warning time is 20%. When the application force of the user for wrenching the work piece reaches 56 N-m, the operation unit 60 activates the warning unit 70 to give a warning to make the user stop wrenching. According to different operators, after inertly applying a force to the work piece, the torque value may reach between 61 N-m and 65 N-m. The user then further increases the tightening torque to 70 N-m to complete the wrenching operation of the work piece.

It can be known from the above description that in the design of the present invention, the set torque value Ts is in reverse proportion to the difference value Δt and in direct proportion to the early-warning time as the following relationship formulas:

$$\text{set torque value } Ts \propto 1/\text{difference value } \Delta t$$

$$\text{set torque value } Ts \propto \text{early-warning time } toa$$

This is because that in case of greater operation torque, a user needs to apply greater force to increase the torque value. Therefore, the increase of the torque value of the inertial application force is smaller so that the early-warning time can be slightly delayed. Reversely, in case of smaller operation torque, the increase of the torque value caused by the inertial application force is greater so that the early-warning time must be made earlier so as to prevent the real torque value exceeds the set torque value Ts after inertly applying a force to the work piece.

Within the ratio range built by the early-warning program, the set torque value Ts is in direct proportion to the early-warning time toa, while the difference value Δt is in reverse proportion to the early-warning time.

Please refer to FIG. 2. The display unit 30 can display the set torque value 32 (the set torque value Ts is 50.0 in the drawing) and the real operation torque value 34 (the real operation torque value is 30.0 in the drawing) for a user to read the set torque value and the magnitude of the current application force.

Figures 8, 9:
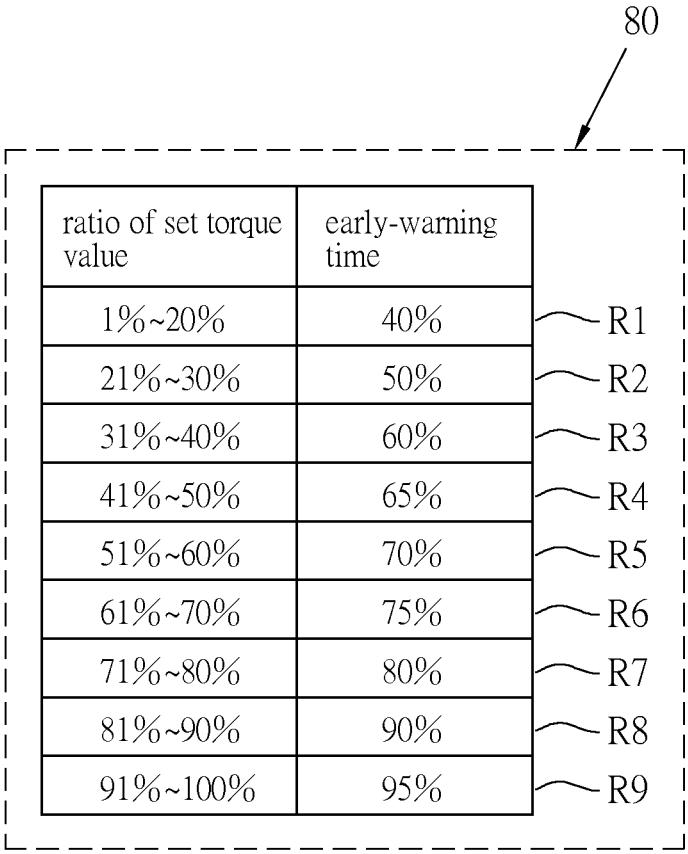
FIG. 8 is a table according to FIG. 7, showing the early-warning time and early-warning torque value of a specific set torque value.
FIG. 9 is another comparison table of the preferred embodiment of the electronic torque wrench of the present invention, showing the relationship between the set torque value and the early-warning time.

Please now refer to FIGS. 7 and 8. FIG. 7 is a comparison table of the preferred embodiment of the electronic torque wrench of the present invention, showing the relationship between the set torque value and the early-warning time in a second application. FIG. 8 is a table according to FIG. 7, showing the early-warning time and early-warning torque value of a specific set torque value. With a range of the operation torque of the wrench 10 from 10 N-m to 200 N-m taken as an example, when the torque for tightening the work piece is set 48 N-m, the ratio of the set torque value falls within the range R2 from 21% to 30%. At this time, the set torque value is applicable to the early-warning time toa of 50% and the early-warning torque value Ta is 24 N-m and the difference value Δt of the early-warning time is 50%. In this case, when the application force for wrenching the work piece reaches 24 N-m, the warning unit 70 gives a warning to make the user stop wrenching.

In the case that the torque for tightening the work piece is set 190 N-m, the ratio of the set torque value falls within the range R7 from 91% to 100%. At this time, the set torque value is applicable to the early-warning time toa of 95% and the early-warning torque value Ta is 180.5 N-m and the difference value Δt of the early-warning time is 5%. When the application force of the user for wrenching the work piece reaches the early-warning torque value, the operation unit 60 activates the warning unit 70 to give a warning to make the user stop wrenching.

FIG. 9 is another comparison table of the preferred embodiment of the electronic torque wrench of the present invention, showing the relationship between the set torque value and the early-warning time set by the early-warning program. In this application, nine ratio ranges R1 to R9 and nine early-warning times are provided to make the early-warning time and the early-warning torque value finer.

Please now refer to FIGS. 10 and 11. FIG. 10 is a comparison table of the preferred embodiment of the electronic torque wrench of the present invention, showing the relationship between the set torque value and the early-warning time in a third application. FIG. 11 is a table according to FIG. 10, showing the early-warning time and early-warning torque value of a specific set torque value. The third application employs the early-warning ranges as shown in FIG. 9. In this application, with a range of the operation torque of the wrench 10 from 10 N-m to 100 N-m taken as an example, when the set torque value Ts is 26 N-m, the operation condition falls within the range R2 from 21% to 30%. At this time, the early-warning time toa is 50% and the early-warning torque value Ta is 13 N-m and the difference value Δt is 50%. When the operation torque Tr reaches 13 N-m, the operation unit 60 urges the warning unit 70 to give a warning to remind the user to stop wrenching. Accordingly, the operation torque value will not exceed the set torque value after inertly applying a force to the work piece.

When the set torque value Ts is 76 N-m, the operation condition falls within the range R7 from 71% to 80%. At this time, the early-warning time is 80% and the early-warning torque value Ta is 60.8 N-m and the difference value Δt is 20%. When the operation torque Tr reaches 60.8 N-m, the warning unit 70 gives a warning to remind the user to stop wrenching. When the set torque value Ts is 100 N-m, the early-warning time is 95% and the early-warning torque value Ta is 95 N-m and the difference value Δt is 5%. When the operation torque Tr reaches 95 N-m, the warning unit 70 gives a warning to make the user stop wrenching. Accordingly, the operation torque will not exceed the set torque value after inertly applying a force to the work piece.

The electronic torque wrench of the present invention has early-warning function and is able to give a warning before the operation torque reaches the set torque value to make a user stop wrenching a work piece in time. Therefore, the work piece will not be over-tightened due to inertial application force.

Moreover, the early-warning function of the present invention is automatically adjustable/settable to have different early-warning times according to different values of the necessary tightening torques. The early-warning time is in reverse proportion to the tightening torque of the work piece so that the present invention is applicable to different situations necessitating different tightening torques.

The various values mentioned in the specification are for illustration purposes only. In practice, the embodiment of the present invention is not limited to these values. For example, the ranges can be, but not limited to, classified by the multiples of five or ten and the values of the early-warning times can be also the multiples of five or ten. The present invention is novel technique in this field and can effectively solve the problem of the conventional electronic torque wrench caused by inertial application force.

The above embodiments are only used to illustrate the present invention, not intended to limit the scope thereof. Many modifications of the above embodiments can be made without departing from the spirit of the present invention.

What is claimed is:

1. An electronic torque wrench with early-warning function, comprising:

a main body;

a working head disposed at one end of the main body;

a display unit disposed on the main body;

a setting unit disposed on the main body for setting a set torque value;

a detecting unit disposed in the main body for detecting operation torque of the wrench;

an operation unit disposed in the main body and connected to the setting unit and the detecting unit;

a warning unit disposed in the main body and connected to the operation unit; and an early-warning program disposed in the main body, the early-warning program being set with multiple early-warning times with different ratio ranges, the early-warning time being defined as a ratio value of the operation torque value of the wrench to a set torque value when an early-warning effect is activated, the value of the early-warning time being in direction proportion to the set torque value, when the operation torque of the wrench reaches the corresponding early-warning time, the operation unit urging the warning unit to give a warning.

2. The electronic torque wrench as claimed in claim 1, wherein the wrench has a maximum operation torque value, the ratio of the set torque value to the maximum operation torque value being a ratio of the set torque value, according to the ratio of the set torque value, the early-warning program classifying the set torque value into multiple ratio ranges, multiple early-warning times falling within the ratio ranges of the set torque value respectively, within the ratio ranges, the ratio of the set torque value being in direct proportion to the value of the early-warning time.

3. The electronic torque wrench as claimed in claim 2, wherein the ranges are classified by multiples of five or ten and the values of the early-warning times are the multiples of five or ten.

4. The electronic torque wrench as claimed in claim 1, wherein the set torque value and the corresponding early-warning time define an early-warning torque value, when the operation torque of the wrench reaches the early-warning torque value, the operation unit urging the warning unit to give a warning.

5. The electronic torque wrench as claimed in claim 4, wherein the early-warning torque value is a product of the set torque value and the early-warning time.

6. The electronic torque wrench as claimed in claim 5, further comprising a comparison unit connected to the operation unit or inbuilt in the operation unit, the comparison unit serving to compare the operation torque of the wrench with the early-warning torque value.

7. An electronic torque wrench with early-warning function, comprising:

a main body;

a working head disposed at one end of the main body;

a display unit disposed on the main body;

a setting unit disposed on the main body for setting a set torque value;

a detecting unit disposed in the main body for detecting operation torque of the wrench;

an operation unit disposed in the main body and connected to the setting unit and the detecting unit;

a warning unit disposed in the main body and connected to the operation unit; and an early-warning program disposed in the main body, the early-warning program being set with multiple early-warning times with different ratio ranges, the early-warning time being defined as a ratio value of the operation torque value of the wrench to a set torque value when an early-warning effect is activated, a difference value existing between each early-warning time of the early-warning program and the operation torque of completion of tightening of the work piece, the set torque value being in reverse proportion to the difference value, when the operation torque of the wrench reaches the corresponding early-warning time, the operation unit urging the warning unit to give a warning.

8. The electronic torque wrench as claimed in claim 7, wherein the wrench has a maximum operation torque value, the ratio of the set torque value to the maximum operation torque value being a ratio of the set torque value, according to the ratio of the set torque value, the early-warning program classifying the set torque value into multiple ratio ranges, multiple early-warning times falling within the ratio ranges of the set torque value respectively, within the ratio ranges, the ratio of the set torque value being in direct proportion to the value of the early-warning time.

9. The electronic torque wrench as claimed in claim 8, wherein the ranges are classified by multiples of five or ten and the values of the early-warning times are the multiples of five or ten.

10. The electronic torque wrench as claimed in claim 7, wherein the set torque value and the corresponding early-warning time define an early-warning torque value, when the operation torque of the wrench reaches the early-warning torque value, the operation unit urging the warning unit to give a warning.

11. The electronic torque wrench as claimed in claim 10, wherein the early-warning torque value is a product of the set torque value and the early-warning time.

12. The electronic torque wrench as claimed in claim 11, further comprising a comparison unit connected to the operation unit or inbuilt in the operation unit, the comparison unit serving to compare the operation torque of the wrench with the early-warning torque value.

13. An electronic torque wrench with early-warning function, comprising:

a main body;

a working head disposed at one end of the main body;

a display unit disposed on the main body;

a setting unit disposed on the main body for setting a set torque value;

a detecting unit disposed in the main body for detecting operation torque of the wrench;

an operation unit disposed in the main body and connected to the setting unit and the detecting unit;

a warning unit disposed in the main body and connected to the operation unit; and multiple ranges inbuilt in the torque wrench and operating with the operation unit, multiple early-warning times with different ratio ranges falling within the ranges respectively, the early-warning time being defined as a ratio value of the operation torque value of the wrench to a set torque value when an early-warning effect is activated, the value of the early-warning time being in direct proportion to the set torque value, when the operation torque of the wrench reaches the corresponding early-warning time, the operation unit urging the warning unit to give a warning.

14. The electronic torque wrench as claimed in claim 13, wherein the set torque value and the corresponding early-warning time define an early-warning torque value, when the operation torque of the wrench reaches the early-warning torque value, the operation unit urging the warning unit to give a warning.

15. The electronic torque wrench as claimed in claim 14, wherein the early-warning torque value is a product of the set torque value and the early-warning time.

16. The electronic torque wrench as claimed in claim 15, further comprising a comparison unit connected to the operation unit or inbuilt in the operation unit, the comparison unit serving to compare the operation torque of the wrench with the early-warning torque value.

17. The electronic torque wrench as claimed in claim 13, wherein the ranges are classified by multiples of five or ten and the values of the early-warning times are the multiples of five or ten.

* * * * *